US007806302B2

(12) United States Patent
Rager

(10) Patent No.: US 7,806,302 B2
(45) Date of Patent: Oct. 5, 2010

(54) PERSONAL FLUID DISPENSERS WITH FEATURES FOR AIDING PORTABILITY AND USE

(75) Inventor: Wesley F. Rager, Acworth, GA (US)

(73) Assignee: Joseph S Kanfer, Richfield, OH (US)

( * ) Notice: Subject to any disclaimer, the term of this patent is extended or adjusted under 35 U.S.C. 154(b) by 1143 days.

(21) Appl. No.: 11/066,918

(22) Filed: Feb. 24, 2005

(65) Prior Publication Data

US 2006/0186145 A1 Aug. 24, 2006

(51) Int. Cl.
*B65D 37/00* (2006.01)

(52) U.S. Cl. ..... 222/215; 222/107; 222/556; 222/562; 220/666; 220/669; 215/382; 215/384

(58) Field of Classification Search ..... 222/215, 222/556, 92, 107, 206, 562, 666, 669, 670–671; 215/382–384, 379
See application file for complete search history.

(56) References Cited

U.S. PATENT DOCUMENTS

| | | | | | |
|---|---|---|---|---|---|
| D240,017 | S | | 5/1976 | Trott | D9/59 |
| D311,133 | S | | 10/1990 | Wiseman et al. | D9/370 |
| D323,780 | S | * | 2/1992 | Addante | D9/521 |
| D343,360 | S | | 1/1994 | Poo | D9/521 |
| D355,603 | S | | 2/1995 | Braun | D9/521 |
| D378,733 | S | | 4/1997 | Asaff et al. | D9/337 |
| D400,444 | S | * | 11/1998 | Laubach et al. | D9/542 |
| D430,802 | S | | 9/2000 | Adachi et al. | D9/521 |
| D438,804 | S | | 3/2001 | Gonda et al. | D9/542 |
| D444,066 | S | | 6/2001 | Fenton et al. | D9/521 |
| D444,386 | S | * | 7/2001 | Weber | D9/521 |
| D464,874 | S | | 10/2002 | Tune et al. | D9/300 |

* cited by examiner

*Primary Examiner*—Frederick C. Nicolas
(74) *Attorney, Agent, or Firm*—Renner, Kenner, Greive, Bobak, Taylor & Weber

(57) ABSTRACT

A personal fluid dispenser includes a flexible container holding fluid to be dispensed. The flexible container is defined by a front wall, a rear wall, rounded shoulders joining a portion of the front wall to the rear wall, opposed rounded side walls extending from the rounded shoulders and joining additional portions of the front wall to the rear wall, a dispensing end providing access to the interior volume of the container; and a closed insertion end opposite the dispensing end and defined by first and second tapered walls meeting at a rounded apex, the insertion end joining additional portions of the front wall to the rear wall, the opposed rounded side wall also joining the first and second tapered walls along a portion thereof.

5 Claims, 2 Drawing Sheets

PERSONAL FLUID DISPENSERS WITH FEATURES FOR AIDING PORTABILITY AND USE

TECHNICAL FIELD

The present invention generally relates to fluid dispensers, and, more particularly, relates to personal, portable fluid dispensers that provide features that make them readily and comfortably portable and easy to use.

BACKGROUND OF THE INVENTION

Portable containers for dispensing fluids or flowable material (hereinafter "fluids") are generally known as semi-rigid containers that can be selectively opened or closed so that the solution retained in the container may be dispensed. These containers are herein termed "semi-rigid" because, although being formed of somewhat rigid materials, they give to pressure in order to allow their interior volume to be temporarily decreased to dispense some of the fluid retained therein. These types of portable dispensers are very popular for carrying around hand sanitizer, hand cleaner, and hand lotion.

The prior art personal dispensers generally target all potential users of the dispenser and therefor take a shape that is acceptable for all types of use. Many of the personal dispensers of the prior art are small enough to fit in a purse or pocket and are also provided with flat bottom surfaces and rather abrupt edges so as to be readily received for use on a counter or shelf. By configuring personal dispensers in this manner a large cross section of consumers is targeted, including both those who desire to carry a personal dispenser on their person and those who wish to leave the dispenser at a convenient location for use (e.g. bathroom counter top). Because present dispensers are designed to simultaneously accommodate these different types of use (counter top use and on-the-go use), they fail to provide features that would be particularly beneficial for those individuals desiring only portable use.

As already mentioned, the personal dispensers of the prior art have abrupt edges. These edges can make the dispenser feel uncomfortable in a pocket, and can make it difficult to insert or remove the dispenser from a pocket. Particularly, the bottom surface of prior art dispensers is flat, for resting on a counter, and this flat bottom surface is opposite the dispensing end at which the fluid is dispensed. As a result of this construction, it is the flat bottom surface that is first inserted into a pocket, in order to maintain the dispensing end above the bottom and thereby avoid or at least limit any potential for the dispenser to leak. The flat bottom surface and the abrupt edges that define it are not conducive to insertion into a pocket. The typical abrupt edges defining the general area around the dispensing end are likewise not conducive to removal from a pocket.

Sharp corners or edges on such dispensers also provide points of concentrated forceful impact against an individual's body, which can give rise to significant bruising commensurate with the contact force. For example, outdoor sports enthusiasts and military personnel may find themselves in situations where the dispenser is interposed between the individual's body and the ground, a tree or the like, in forceful interengagement. Sharp or abrupt edges or corners in even a flexible container are necessarily hard or rigid, and forceful contact with the same is often injurious.

Many individuals who use personal dispensers do not necessarily need a dispenser that can rest on a counter, and could benefit from a personal dispenser more specifically tailored for pocket transport, and absent rigid edges or corners. These include hunters, hikers, campers, military personnel, and, indeed, anyone on the go that might need a personal dispenser for dispensing a particular product. The product might be hand cleaner, hand sanitizer, sun screen, bug repellant, or any other fluid.

In addition to the need for personal dispensers more tailored for pocket transport, there is a need for personal dispensers with other constructions that aid in use and which might be particularly useful for people on the go that do not necessarily need a personal dispenser that rests on a counter.

SUMMARY OF THE INVENTION

In accordance with this invention, a personal fluid dispenser includes a container holding fluid to be dispensed. The container is defined by a front wall, a rear wall, rounded shoulders joining a portion of the front wall to the rear wall, opposed rounded side walls extending from the rounded shoulders and joining additional portions of the front wall to the rear wall, a dispensing end providing access to the interior volume of the container and a closed insertion end opposite the dispensing end and defined by first and second tapered walls meeting at a rounded apex, the insertion end joining additional portions of the front wall to the rear wall, the opposed rounded side walls also joining the first and second tapered walls along a portion thereof.

This construct provides a personal dispenser that can be easily inserted into a pocket, in an upright manner that puts the contents of the container a distance away from the dispensing end, where it might leak in a different orientation. The rounded side walls are easily grasped in a user's hand to facilitate use of the dispenser, and, in preferred embodiments, include finger detents to provide a comfortable grip. The rounded, smooth design of the personal dispenser as a whole provides for comfortable receipt in a pocket, and the apex can rest intimately at the bottom seam of a pocket to be space efficient, while eliminating hard or rigid corners that could prove injurious to the user in activities resulting in forceful contact with the user's body. And in some embodiments, the material from which the personal dispenser is designed further prevents discomfort. In other embodiments, the outlet at the dispensing end is oriented to facilitate use. For particular applications, including camping, hunting, and military, the personal dispenser is sized to provide a generally acceptable number of dispenses.

PREFERRED EMBODIMENT FOR CARRYING OUT THE INVENTION

Figure 1:
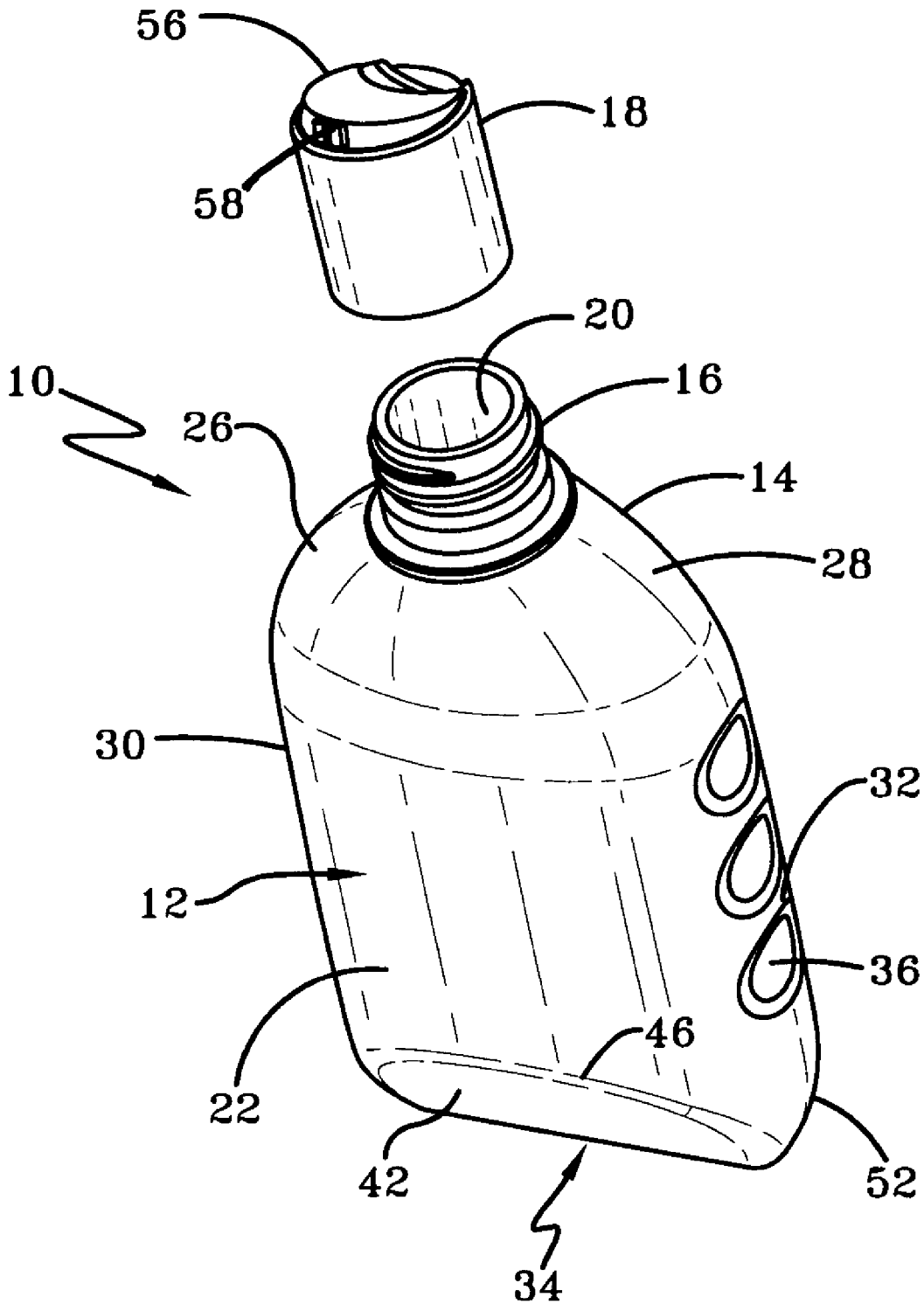
FIG. 1 is a perspective view of a preferred embodiment of a personal fluid dispenser in accordance with this invention.
Figure 3:
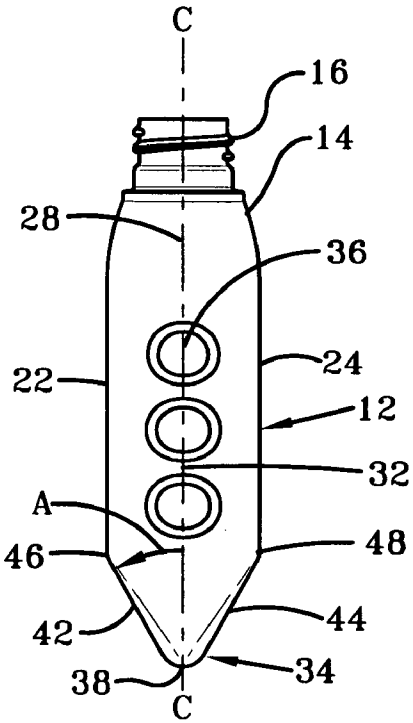
FIG. 3 is a side elevational view thereof without its cap.
Figure 2:
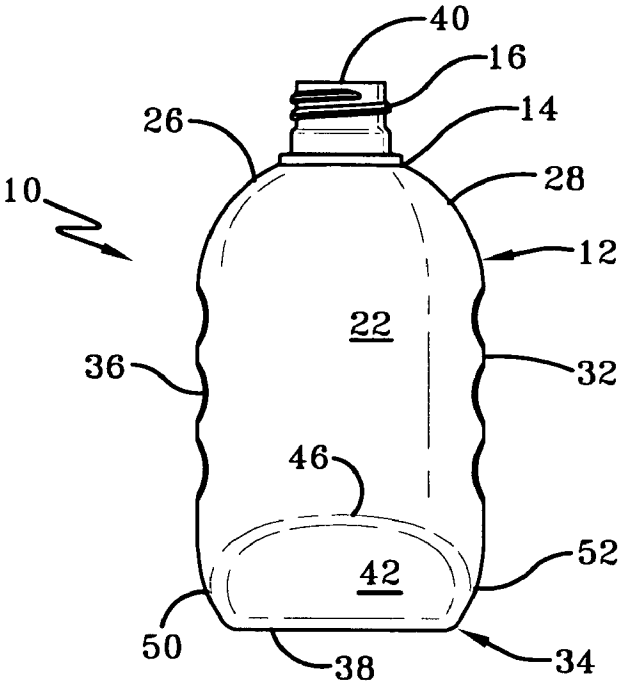
FIG. 2 is a front elevational view of the personal dispenser without its cap.

Referring now to FIGS. 1-3, a preferred embodiment of a personal fluid dispenser in accordance with this invention is shown and designated by the numeral 10. Dispenser 10 includes container 12 that holds fluid to be dispensed. Container 12 is closed at dispensing end 14, particularly at threaded neck 16, by cap 18, which is removably threaded onto threaded neck 16 to seal the conduit 20 that provides access to the interior volume of container 12. The exterior of container 12 preferably has an earth tone appearance. In particular embodiments, it is a desert sand, olive drab, or camouflage color.

Container 12 is defined by front wall 22, rear wall 24, first and second rounded shoulders 26, 28 (respectively numbered), first and second rounded side walls 30, 32 (respectively numbered), and closed insertion end 34, which is opposite dispensing end 14, more particularly, threaded neck 16, which also defines a portion of container 12. Front wall 22 and rear wall 24 extend from dispensing end 14, at the base of threaded neck 16, to closed insertion end 34, and rounded shoulders 26, 28 serve to join a portion of front wall 22 to rear wall 24. This joinder provides for no abrupt edges, as shown in the drawings and as implied by the term "rounded," which is used to define shoulders 26, 28. In addition to joining front wall 22 and rear wall 24, rounded shoulders 26, 28 also join respectively to side walls 30 and 32. Side walls 30, 32 also join front wall 22 to rear wall 24 along the portion extending from rounded shoulders 26, 28 to closed insertion end 34. These opposed rounded side walls 30, 32 are also devoid of abrupt edges. Preferably, side walls 30, 32 each include a plurality of finger grip detents 36 that provide a means for comfortably gripping container 12.

Closed insertion end 34, as its name implies, is provided for aiding in the insertion of dispenser 10 into a user's pocket. Insertion end 34 is defined by front tapered wall 42 and rear tapered wall 44 that meet at rounded apex 38. Tapered walls 42, 44 also join additional portions of front wall 22 and rear wall 24, as at their rounded top edges 46, 48. Rounded side walls 30, 32 also join front and rear tapered walls 42, 44 along a portion thereof, as at opposed base shoulders 50, 52. Tapered walls 42, 44 preferably extend at an angle A of from 15° to 50°, more preferably from 20° to 45°, and most preferably from 29° to 32° with respect to center plane C to aid in the insertion of dispenser 10 into a pocket. In a particular embodiment, angle A is approximately 30°. With such angled walls 42, 44, apex 38 can rest directly up against the seam of a pocket, to be more space efficient than prior art dispensers having flat bottom surfaces with abrupt edges (typically perpendicular) joining the side walls. Aside from the somewhat abrupt edges at cap 18 (or the top of threaded neck 16) dispenser 10, as a whole, provides rounded surfaces that fit comfortably in a pocket or hand and eliminate pressure points at areas of bodily contact. More particularly, when received in a pocket, the edges of cap 18 edges have little impact on the feel of the dispenser 10 because the cap lies within the depth and width dimensions. Container 12 is preferably made from polypropylene or another suitable plastic, rubber, or elastomer, preferably having a durometer of from about 70-100, more preferably 80-90, and most preferably approximately 85 (Rockwell R) or a Shore D hardness of from 60-75, more preferably 65-70, and most preferably approximately 68.

Container 12 is thus preferably sized to fit within a pocket, and, inasmuch as finger detents 36 are provided, it is also preferably shaped to fit comfortably in a user's hand. Preferably, the width of container 12, between side walls 30 and 32 is from about 2 to 2.5 inches. The height, from apex 38 to the top 40 of threaded neck 16 is from 4 to 4.5 inches. The depth of container 12, between front wall 22 and rear wall 24 is preferably from 1 to 1.5 inches. In a particularly preferred embodiment, the width is 2.25 inches, plus or minus 0.06 inches; the height is 4.282 inches, plus or minus 0.05 inches; and the depth is 1.2 inches, plus or minus 0.05 inches. It has been found that these dimensions provide a container 12 that can be comfortably held in the hand of a large cross section of the community. Additionally, given typical material thicknesses for creating container 12, it has been found that these dimensions provide a container that can hold a suitable amount of fluid for particular applications for a personal dispenser. For example, for camping, hunting, or military applications, such a container 12 would contain a suitable amount of fluid allowing for a suitable number of fluid dispensings for a camping, hunting or military expedition. In a particularly preferred embodiment, the fluid to be dispensed is a hand sanitizer, and container 12 would hold from about 120 to about 150 doses of the hand sanitizer, assuming that the average amount dispensed is from about 0.60 to about 0.75 cc.

Figure 4:
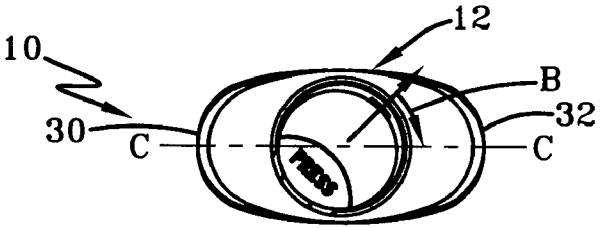
FIG. 4 is a top plan view thereof, with its cap on and with the dispensing direction through the cap being represented by an arrow.

Referring now to FIGS. 1 and 4, it can be seen that cap 18 is preferably a flip disk cap, having a flip disk 56 that selectively pivots between an open and closed position. In the open position, as shown in FIG. 1, fluid conduit 58 extends through cap 18 to open conduit 20 of threaded neck 16, more particularly, to open the interior of container 12 to the ambient atmosphere. Such flip disk caps are generally known and need not be more specifically disclosed. Rather, what is of importance for preferred embodiments of this invention is the orientation of the opening of fluid conduit 58 on flip disk 56 in relation to center plane C. In preferred embodiments, when cap 18 is securely threaded on threaded neck 16, flip disk 56 is positioned such that, when flipped open to expose fluid conduit 58, the opening of fluid conduit 58 dispenses fluid at an angle B of from 0° to 45°, more preferably from 10° to 35°, most preferably 20° to 30° in relation to center plane C. It has been found that this configuration facilitates the dispensing of fluid, particularly hand sanitizer or other hand-applied fluids, into one hand, when the container 12 is gripped in the other.

In light of the foregoing, it should thus be evident that the product of the present invention, providing a personal fluid dispenser, substantially improves the art. While, in accordance with the patent statutes, only the preferred embodiments of the present invention have been described in detail hereinabove, the present invention is not to be limited thereto or thereby. Rather, the scope of the invention shall include all modifications and variations that fall within the scope of the attached claims.

The invention claimed is:

1. A personal fluid dispenser comprising:

a container holding fluid to be dispensed, said container being defined by:

a front wall;

a rear wall;

rounded shoulders joining a portion of said front wall to said rear wall;

opposed rounded side walls extending from said rounded shoulders and joining additional portions of said front wall to said rear wall;

a dispensing end having a threaded neck providing a conduit providing access to the interior volume of said container;

a cap removably threaded on to said threaded neck to seal said conduit, said cap having an open position that provides a fluid conduit through said cap and joining to said conduit of said neck; and a closed insertion end opposite said dispensing end and defined by first and second tapered walls meeting at a rounded apex, said insertion end joining additional portions of said front wall to said rear wall, said opposed rounded side walls also joining said first and second tapered walls along a portion thereof, wherein the joining of all said walls and shoulders are gently rounded such that said container provides no abrupt edges, wherein said rounded apex of said closed insertion end lies in a center plane that is parallel to said front and rear walls and equidistant from them, and said cap seats on said threaded neck, when threaded thereon, so as to dispense said fluid at an angle from 0° to 45° with respect to said center plane.

2. A personal fluid dispenser as in claim 1, further comprising a plurality of finger grip detents on said opposed rounded side walls.

3. A personal fluid dispenser as in claim 1, wherein said rounded apex of said closed insertion end lies in a center plane that is parallel to said front and rear walls and equidistant from them, and said first and second tapered walls extend from said apex at an angle of from 15° to 50° with respect to said center plane.

4. A personal fluid dispense as in claim 1, wherein said container is a color selected from desert sand, olive drab, and camouflage.

5. A personal fluid dispenser comprising:

a container holding fluid to be dispensed, said container being defined by:

a front wall;

a rear wall;

rounded shoulders joining a portion of said front wall to said rear wall;

opposed rounded side walls extending from said rounded shoulders and joining additional portions of said front wall to said rear wall;

a dispensing end having a threaded neck providing a conduit providing access to the interior volume of said container;

a flip disk cap removably threaded onto said threaded neck to seal said conduit, said flip disk cap selectively pivoting between an open and closed position, said open position opening a fluid conduit through said cap and joining to said conduit of said neck; and a closed insertion end opposite said dispensing end and defined by first and second tapered walls meeting at a rounded apex, said insertion end joining additional portions of said front wall to said rear wall, said opposed rounded side walls also joining said first and second tapered walls along a portion thereof, wherein the joining of all said walls and shoulders are gently rounded such that said container provides no abrupt edges, wherein said rounded apex of said closed insertion end lies in a center plane that is parallel to said front and rear walls and equidistant from them, and said flip disk cap seats on said threaded neck, when threaded thereon, so as to dispense said fluid at an angle of from 0° to 45° with respect to said center plane.

* * * * *